United States Patent [19]

Kimura et al.

[11] Patent Number: 4,661,152

[45] Date of Patent: Apr. 28, 1987

[54] METHOD OF LANCING FOR A COPPER-PRODUCING CONVERTER

[75] Inventors: Takayoshi Kimura; Seiichi Tsuyuguchi, both of Niihama, Japan

[73] Assignee: Sumitomo Metal Mining Company Limited, Tokyo, Japan

[21] Appl. No.: 800,403

[22] Filed: Nov. 21, 1985

[30] Foreign Application Priority Data

Nov. 26, 1984 [JP] Japan ..... 59-249332

[51] Int. Cl.[4] ..... C22B 15/06

[52] U.S. Cl. ..... 75/76; 266/221; 266/225; 266/270

[58] Field of Search ..... 75/76; 266/221, 225, 266/270

[56] References Cited

U.S. PATENT DOCUMENTS 3,666,440 5/1972 Kono ..... 75/76

4,073,646 2/1978 Kryczun ..... 75/76

*Primary Examiner*—Peter D. Rosenberg

*Attorney, Agent, or Firm*—Watson, Cole, Grindle & Watson

[57] ABSTRACT

A method of oxygen lancing for a copper-producing converter. An oxygen-enriched gas, such as oxygen-enriched air or pure oxygen, having a gage pressure of at least 1 kg/cm$^2$ is blown onto the surface of a molten bath through at least one top lancing tube of the non-immersion type having a lower end located within the converter and held at a height within 0.4 m above the surface of the bath as measured when the bath is at a standstill, while air is simultaneously blown into the bath through tuyeres.

8 Claims, 5 Drawing Figures

METHOD OF LANCING FOR A COPPER-PRODUCING CONVERTER

BACKGROUND OF THE INVENTION

1. Field of the Invention

This invention relates to a method of lancing for a copper-producing converter which is used to produce crude copper from a matte.

2. Description of the Prior Art

A copper-producing converter is a furnace in which air or oxygen-enriched air is blown into a molten matte through tuyeres located below the surface of the molten matte to oxidize it to, thus removing iron and sulfur therefrom to produce crude copper. The cycle of its operation is divided into a stage of slag forming and a stage of blister forming. During the stage of slag forming, FeS is oxidized into FeO and sulfur is oxidized into $SO_2$ and exhausted. If FeO is further oxidized, it forms $Fe_3O_4$, but this substance has a high melting point and a high degree of viscosity and is thus undesirable for the operation of the furnace. Therefore, the furnace is charged with a flux, such as solid silica, so that FeO may combine with $SiO_2$ in the flux to form a slag and be removed. The stage of blister forming follows the stage of slag forming. The molten material from which iron has been separated during the stage of slag forming is further oxidized, and the reactions which may, for example, be expressed by the following equations take place to produce crude copper. $Cu_2S+O_2=2Cu+SO_2$, $Cu_2S+2Cu_2O=6Cu+SO_2$. All of the reactions which take place during the stage of slag forming and blister forming are exothermic. If the molten material has too high a temperature, it is likely to damage the brick lining of the furnace. Therefore, it is usual to introduce a cold charge, such as copper scrap or smoke dust, for controlling the temperature of the molten material, as well as for increasing the production of crude copper.

Insofar as the reactions taking place in the furnace are such that the iron and sulfur in the matte combine with the oxygen in the air blown into the matte, an increase in the oxygen content of the air brings about a reduction in the time required by the reactions and an increase in the amount of heat produced per unit time. If air having a higher oxygen content is employed, it is possible to increase the quantity of the matte treated per unit time and the amount of the cold charge employed. Therefore, the use of air having a higher oxygen content is an effective way to raise the productivity of a copper-producing converter.

If air having a higher oxygen content is blown into the furnace through the tuyeres, however, an increased amount of heat is generated in the vicinity of the tuyeres and greatly damages the brick lining in their vicinity. It is, therefore, understood in the art that oxygen-enriched air having an oxygen content of only up to about 30% can be blown through the tuyeres. It is only to a limited extent that the quantities of the matter and the cold charge can be increased. Moreover, the wear of the brick lining around the tuyerers gives rise to a noticeable reduction in the life of the furnace, even if air having an oxygen content of only about 30% is used.

SUMMARY OF THE INVENTION

It is an object of this invention to overcome the drawbacks of the prior art as hereinabove pointed out and to provide a method of oxygen lancing for a copper-producing converter which makes it possible to increase the quantities of the matte and the cold charge as desired without involving any accelerated wear of the brick lining around the tuyeres.

This object is attained by a method which comprises blowing an oxygen-enriched gas having a pressure of at least 1 kg/cm$^2$ (gage pressure) onto a molten bath in the converter through at least one top lancing tube of the non-immersion type having a lower end held at a height within 0.4 m above the surface of the bath as measured when the bath is at a standstill, while simultaneously blowing air into the bath through tuyeres located below the surface of the bath.

DETAILED DESCRIPTION OF THE INVENTION

Figure 2:
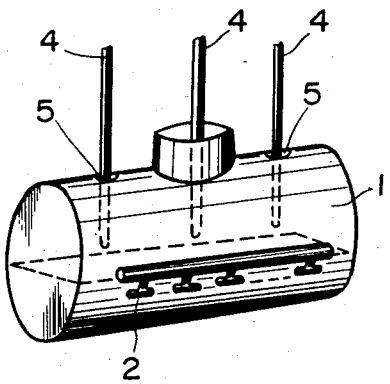
FIG. 2 is a schematic perspective view of a copper-producing converter which can be used to carry out the method of this invention.
Figure 3:
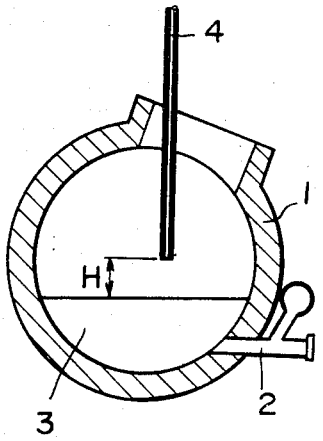
FIG. 3 is a cross sectional view of the converter shown in FIG. 2.

A copper-producing converter which can be used to carry out the method of this invention is schematically shown by way of example in FIGS. 2 and 3. The converter 1 is provided with a plurality of tuyeres 2, each having an inner end located below the surface of a molten bath 3 when the converter 1 is in its upstanding position. The converter 1 is also provided with a plurality of top lancing tubes 4 of the nonimmersion type which are vertically movable so that each of them may have its lower end held at a level of height somewhat above the surface of the bath 3. If the converter is relatively small, it is sufficient to employ only a single top lancing tube which is introduced into the converter through its top central opening. If the converter is large, however, it is preferable to employ a plurality of top lancing tubes 4, one of which is introduced through the top central opening of the converter, while the other tubes 4 extend into the converter through a plurality of holes 5 which are provided through the top of the converter on both sides of its top central opening, as shown in FIG. 2. Each top lancing tube 4 can be formed from an ordinary or stainless steel tube which, if necessary, may be cooled with water. The use of tubes to which refractories have been fused is preferred from the standpoints of wear resistance and safety.

An oxygen-enriched gas, such as oxygen-enriched air or pure oxygen, is blown onto the surface of the molten bath 3 through the top lancing tubes 4, while air is blown into the bath 3 through the tuyeres 2 as known in the art. According to this invention, it is important to maintain an appropriate lancing pressure, i.e., pressure of the gas supplied to the top lancing tubes 4, and an appropriate distance between the lower ends thereof and the surface of the bath 3, in order to ensure that the gas which has been blown through the top lancing tubes 4 may be used effectively for oxidizing purposes.

Figure 1:
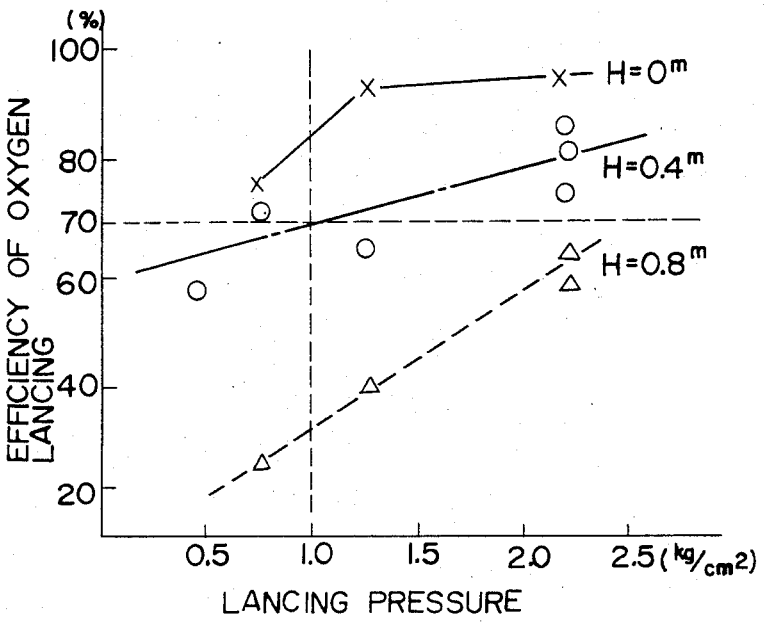
FIG. 1 is a graph showing the efficiency of oxygen lancing in relation to the lancing pressure and the height of the lower end of a top lancing tube above the surface of a molten bath as measured when the bath is at a standstill.

FIG. 1 shows by way of example of efficiency of oxygen lancing, which is the percentage of the oxygen blown through a top lancing tube and used effectively for oxidizing purposes, in relation to the lancing pressure and the height H of the lower end of the tube above the surface of a molten bath as measured when the bath was at a standstill before lancing was started. The efficiency of oxygen lancing was found to drop with a reduction in lancing pressure and with an increase in the height H. The efficiency was generally lower than 70%, which is practically undesirable, if the lancing pressure was lower than 1 kg/cm$^2$, or if the height H was greater than 0.4 m.

According to this invention, therefore, the lower end of the or each top lancing tube is maintained at a height within 0.4 m above the surface of the bath as measured when the bath is at a standstill before lancing is started, and a lancing pressure of at least 1 kg/cm$^2$ is employed. Even if the height H exceeds 0.4 m, the efficiency of oxygen lancing is improved if a lancing pressure exceeding about 3 kg/cm$^2$ can be employed. The use of such a high lancing pressure is, however, usually not recommended, as it gives rise to an increased splash of the molten material and an increased consumption of power.

The combination of the pure oxygen, etc., blown through the top lancing tubes and the air through the tuyeres supplies the converter with an oxidizing gas having a higher oxygen content than when oxygen-enriched air is blown through the tuyeres, and thereby enables the efficient operation of the converter. If the bath has a temperature which is lower than about 1150° C., the splashing material sticks to the top lancing tube and solidifies to form a mass thereon. This mass gradually becomes larger and hinders the proper operation of the converter, as it, for example, disables the movement of the top lancing tube through the hole provided at the top of the converter, or more specifically, on an exhaust gas hood, etc. Therefore, it is advisable to carry out the method of this invention by raising the temperature of the bath to at least 1150° C. quickly, especially during the beginning of the slag forming stage during which the bath temperature is low.

Figure 4:
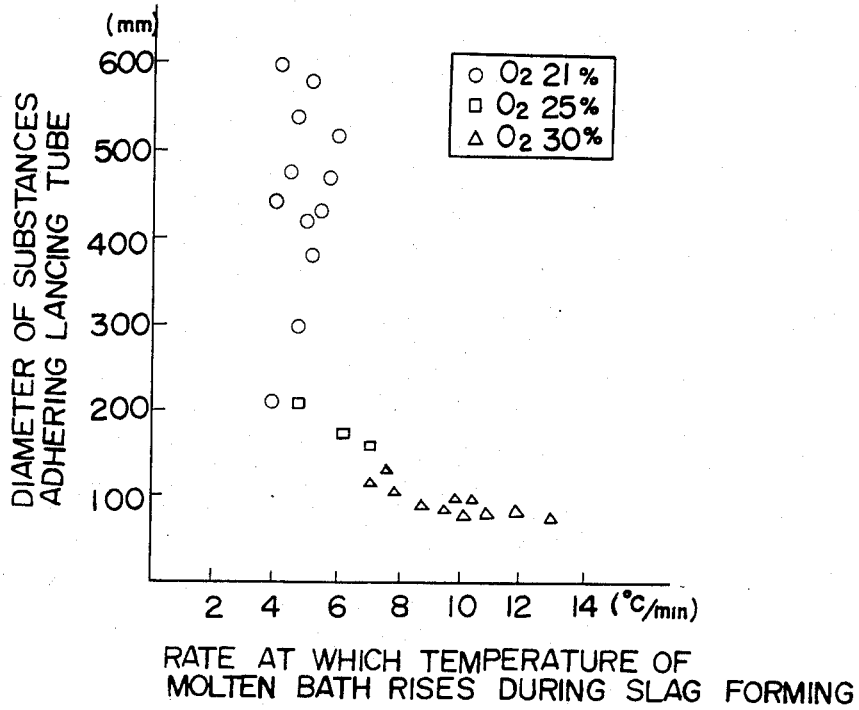
FIG. 4 is a graph showing the diameter of substances adhering to the top lancing tubes in relation to the rate at which the temperature of the molten bath rises during the stage of slag forming.
Figure 5:
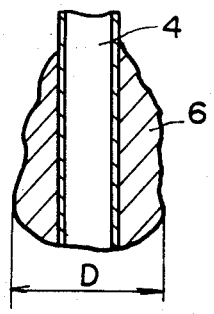
FIG. 5 is a fragmentary longitudinal sectional view of a top lancing tube showing how the diameter of the substance adhering thereto is measured.

FIG. 4 shows by way of example the diameter of a mass of substances which was found adherent to a top lancing tube, in relation to the rate at which the temperature of the bath was raised during the slag forming stage, and the combined oxygen content of the gas which was supplied through the top lancing tube and the air which was supplied through the tuyeres. The diameter D of the mass 6 was obtained by measuring its maximum outside diameter about the top lancing tube 4, as shown in FIG. 5. The tube 4 had an outside diameter of 50 mm. In FIG. 4, the diameters shown by circles are of the masses 6 which were formed when the air not enriched with oxygen, but having an oxygen content of 21% was supplied through the top lancing tube. As is obvious from FIG. 4, the diameters of the masses can be reduced if the combined oxygen content of the gas supplied through the top lancing tube and the air supplied through the tuyeres is increased, therefore the rate at which the bath temperature is raised is increased. The amount of the oxygen-enriched gas which should be supplied through the top lancing tube, in addition to the air supplied through the tuyeres, depends on the quantity of the cold charge. Even if it is not necessary to use a very large quantity of cold charge, but it is sufficient to supply a relatively small amount of gas having a relatively low oxygen content through the top lancing tube, however, it is practically advisable to prevent the adherence of any large mass of the splashing material to the top lancing tube by raising the combined oxygen content of the gas supplied through the top lancing tube and the air supplied through the tuyeres during the beginning of the slag forming stage and lowering it subsequently.

According to this invention, it is only the air not enriched with oxygen that is supplied through the tuyeres, and there is no such local heating of the brick lining around the tuyeres as has presented a serious problem in the prior art. The supply of an oxygen-enriched gas, such as oxygen-enriched air or pure oxygen, through the top lancing tube or tubes produces an oxidizing gas having a high oxygen content in a converter and thereby promotes the oxidizing reactions in the converter effecitvely. The distance between the lower end of the top lancing tube or tubes and the surface of the molten bath and the lancing pressure are maintained at their respective appropriate levels to ensure that the gas which has been supplied through the top lancing tube or tubes be effectively used for the necessary oxidizing purposes to enable a highly efficient operation of the converter.

The invention will now be described more specifically by way of example.

EXAMPLE

Crude copper was produced by employing a method embodying this invention and two conventional methods. In all of these cases, a PS converter having an inside diameter of 1.5 m and a length of 1.68 m was charged with 6.5 tons of a copper matte. When the method of this invention was used, industrial oxygen having a purity of 96% and a gage pressure of 2 kg/cm$^2$ was blown onto the surface of a molten bath at a rate of 870 Nm$^3$/h through a top lancing tube having an inside diameter of 41.6 mm and a lower end held at a height of 0.2 m above the surface of the bath, while air was simultaneously blown into the bath through tuyeres at a rate of 1630 Nm$^3$/h. According to one of the conventional methods, only air was blown through the tuyeres at a rate of 2500 Nm$^3$/h. According to the other conventional method, only oxygen-enriched air having an oxygen content of 34% was supplied through the tuyeres at a rate of 2500 Nm$^3$/h. TABLE 1 compares the three methods in respect of the lancing time, the quantity of the cold material which could be employed, the wear of the brick lining around the tuyeres and the copper content of the slag. It also shows the oxygen content of the oxidizing gas in the converter, which is the combined oxygen content of the oxygen supplied through the top lancing tube and the air supplied through the tuyeres in accordance with this invention, and the efficiency at which oxygen was used for the oxidizing reactions in the converter.

TABLE 1

| | | Method of this invention | Conventional method 1 | Conventional method 2 |
|---|---|---|---|---|
| Quantity of matte (tons) | | 6.5 | 6.5 | 6.5 |
| Its composition | Cu (%) | 53.7 | 54.8 | 54.8 |
| | S (%) | 23.3 | 23.2 | 23.3 |

TABLE 1-continued

| | Method of this invention | Conventional method 1 | Conventional method 2 |
|---|---|---|---|
| Fe (%) | 17.3 | 16.3 | 16.2 |
| Number of tuyeres and their dia. (mm) | 6 × 41.6 mm | 6 × 41.6 mm | 6 × 41.6 mm |
| Supply of air through tuyeres ($Nm^3/h$) | 1360 | 2500 | 2500 |
| Supply of oxygen through top lancing tube ($Nm^3/h$) | 870 | 0 | 0 |
| Oxygen content (%) | 47 | 21 | 34 |
| Oxygen efficiency (%) | 87 | 94 | 98 |
| Lancing or blowing time (h) | 1.2 | 2.3 | 1.6 |
| Cold material employed (kg) | 3000 | 0 | 1920 |
| Wear of brick lining around tuyeres (kg/ton of copper) | 2.0 | 2.0 | 4.0 |
| Copper content of slag (%) | 2.5 | 2.3 | 2.7 |

The results shown in TABLE 1 confirm that the method of this invention enables a shortening of the lancing time, an increase in the amount of the cold material which can be employed, and a redution in the wear of the brick lining around the tuyers, as compared with the conventional method relying upon the supply of oxygen-enriched air through the tuyeres. The loss of copper to the slag does not substantially increase when the method of this invent-on is employed. The oxygen efficiency which can be achieved when the method of this invention is employed is somewhat lower than what is attained when the conventional methods are employed, but is a figure which is quite satisfactory in practice.

We claim:

1. A method of lancing for copper-producing converter which contains a molten bath and a gaseous atmosphere thereabove, said method comprising blowing an oxygen-enriched gas having a gauge pressure of at least 1 $kg/cm^2$ through said gaseous atmosphere and onto the surface of a molten bath through at least one top lancing tube having a lower end held at a height within 0.4 m above the surface of said bath as measured when said bath is at a standstill, while simultaneously blowing air into said bath through tuyeres.

2. A method as set forth in claim 1, wherein said gas and said air have a combined oxygen content which is high during the beginning of a slag forming stage, and which is subsequently lowered.

3. A method as set forth in claim 1, wherein said gas is selected from oxygen-enriched air and pure oxygen.

4. A method as set forth in claim 1, wherein said pressure is from 1 to 3 $kg/cm^2$.

5. A method as set forth in claim 1, wherein said bath has a temperature of at least 1150° C.

6. A method as set forth in claim 1, wherein said top lancing tube comprises a steel tube carrying a refractory material fused thereto.

7. A method as set forth in claim 1, wherein said top lancing tube comprises a tube formed from a material selected from ordinary steel and stainless steel.

8. A method as set forth in claim 1, wherein said top lancing tube is a water-cooled tube.

* * * * *